US008678418B1

(12) United States Patent
Quarles

(10) Patent No.: US 8,678,418 B1
(45) Date of Patent: Mar. 25, 2014

(54) WHEELCHAIR ACCESSORY KIT

(71) Applicant: Tammy Quarles, Columbia, SC (US)

(72) Inventor: Tammy Quarles, Columbia, SC (US)

( * ) Notice: Subject to any disclaimer, the term of this patent is extended or adjusted under 35 U.S.C. 154(b) by 0 days.

(21) Appl. No.: 13/685,863

(22) Filed: Nov. 27, 2012

(51) Int. Cl.
*A47C 31/11* (2006.01)

(52) U.S. Cl.
CPC ..... *A47C 31/11* (2013.01)
USPC ..... 280/304.1

(58) Field of Classification Search
USPC ..... 280/250.1, 304.1; 297/219.1
See application file for complete search history.

(56) References Cited

U.S. PATENT DOCUMENTS 7,278,649 B2 * 10/2007 Daniels ..... 280/304.1
2012/0098742 A1 * 4/2012 Pincus et al. ..... 345/157

* cited by examiner

*Primary Examiner* — J. Allen Shriver, II
*Assistant Examiner* — Felicia L Brittman

(57) ABSTRACT

This patent application discloses a wheelchair accessory kit. The kit may include a wheelchair seat cover that attaches onto an existing wheelchair, and which includes a rearwardly facing pocket and inwardly facing and adjacent side pockets for storing items of an occupant end user. The rearwardly facing pocket of the wheelchair seat cover is an extension of the wheelchair seat cover, which folds over the top of the seat back of the wheelchair. The wheelchair accessory kit further includes grip-forming members that may be installed onto the handles, wheelchair locks, and/or circular rings adjacent of the wheels. The grip-forming member is constructed of a clay polymer material that is press formed onto the surface of the handles and/or circular rings, and which hardens to form an enhanced gripping surface for use of the occupant end user or another person in propelling or locking the wheelchair.

17 Claims, 5 Drawing Sheets

WHEELCHAIR ACCESSORY KIT

BACKGROUND

1. Field

The information disclosed in this patent relates to a kit involving accessories for use with an existing wheelchair.

2. Background Information

A wheelchair is a manually maneuvered device that has been around for a long period of time, and is used where an end user needs assistance in mobilizing. Wheelchairs come in a plurality of sizes, styles, and functional uses. A traditional wheelchair includes two side wheels each of which includes a circular ring that is manually engaged by the end user in order to propel the end user and wheelchair as intended. Most wheelchairs further include a pair of handles that extend from behind the wheelchair such that someone other than the end user can propel the wheelchair and the end user.

The points of contact between the hand of the end user or someone other than the end user shall interact with the circular ring or handles. Such point of contact may not afford good gripping action thereon, which may result in slippage when pushing, propelling, or locking the wheelchair.

Wheelchair seats are not comfortable, nor provide a place with which to store valuables of the end user when in use. Often, the end user will have to place valuables in pockets worn by the end user.

The Ranney Patent Application Publication (U.S. Publication No. 2007/0069560) discloses a cover for a wheelchair or scooter in which the cover has integral storage pockets. However, the cover does not work in conjunction with grip-forming member to customize an existing wheelchair with both enhanced gripping means and a seat cover that includes pouches for storage of several items therein.

The Daniels Patent (U.S. Pat. No. 7,278,649) discloses a wheelchair cover that has integral cushioning or padding located in the seat of the chair. However, the wheelchair cover does not include a pocket for storage of valuables and include grip-forming member that attach to handles and circular rings in order to offer enhanced gripping action to the wheelchair.

The Dinsmoor, III Patent (U.S. Pat. No. 5,333,921) discloses an adjustable cover and cushion system for the seat of a wheelchair. Again, the cover of the Dinsmoor reference does not offer a rearwardly facing pocket that is integrated into the construction of the wheelchair cover in order to offer a place to store valuables of the end user of the wheelchair, nor does it include grip-forming member for use with the wheelchair.

The Hanley Patent (U.S. Pat. No. 5,806,925) discloses a protective breathable seat cover of general interest. The seat cover is not adapted for use with a wheelchair.

The Neustat Patent (U.S. Pat. No. 7,258,399) discloses a slip cover for furniture that has integral cushions or padding. The slip cover is not specifically adapted for use with a wheelchair as a cover that includes a pocket for storing valuables of the occupant end user of the wheelchair.

The Stopyra Patent (U.S. Pat. No. Des. 626,462) illustrates a design for a wheelchair cover. However, the wheelchair cover is not a part of a kit that includes grip-forming member to enhance the gripping action to the handles or circular rings for propelling the wheelchair.

What is needed is a kit that is used with an existing wheelchair, which includes a seat cover having features described above as well as grip-forming member that are applied to the handles, wheelchair locks, and circular rings in order to provide greater gripping friction associated with the respective wheelchair.

SUMMARY

This patent application discloses a wheelchair accessory kit. The kit may include a wheelchair seat cover that attaches onto an existing wheelchair, and which includes a rearwardly facing pocket and inwardly facing and adjacent side pockets for storing items of an occupant end user. The rearwardly facing pocket of the wheelchair seat cover is an extension of the wheelchair seat cover, which folds over the top of the seat back of the wheelchair. The wheelchair accessory kit further includes grip-forming members that may be installed onto the handles, wheelchair locks, and/or circular rings adjacent of the wheels. The grip-forming member is constructed of a clay polymer material that is press formed onto the surface of the handles and/or circular rings, and which hardens to form an enhanced gripping surface for use of the occupant end user or another person in propelling or locking the wheelchair.

It is an object of the invention to provide an accessory kit for use with a previously existing wheelchair in order to provide the wheelchair seat, arms and backs with a soft cover including several pockets for storing valuables of the end user occupant of the wheelchair.

It is a further object of the invention to provide an individualized grip-forming member to be used in conjunction with the wheelchair seat cover, whereby the grip-forming member when installed on surfaces engaged by hand in propelling or locking of said wheelchair will be enhanced with greater gripping action.

An even further object of the invention is to provide the grip-forming member applied onto the handles facing to the rear of the wheelchair, wheelchair locks, and/or circular rings adjacent to a corresponsive wheel, which is grabbed by the occupant end user.

These together with additional objects, features and advantages of the wheelchair accessory kit will be readily apparent to those of ordinary skill in the art upon reading the following detailed description of presently preferred, but nonetheless illustrative, embodiments of the wheelchair accessory kit when taken in conjunction with the accompanying drawings.

In this respect, before explaining the current embodiments of the wheelchair accessory kit in detail, it is to be understood that the wheelchair accessory kit is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the wheelchair accessory kit.

It is therefore important that the claims be regarded as including such equivalent construction insofar as they do not depart from the spirit and scope of the wheelchair accessory kit. It is also to be understood that the phraseology and terminology employed herein are for purposes of description and should not be regarded as limiting.

DETAILED DESCRIPTION

Figure 1:
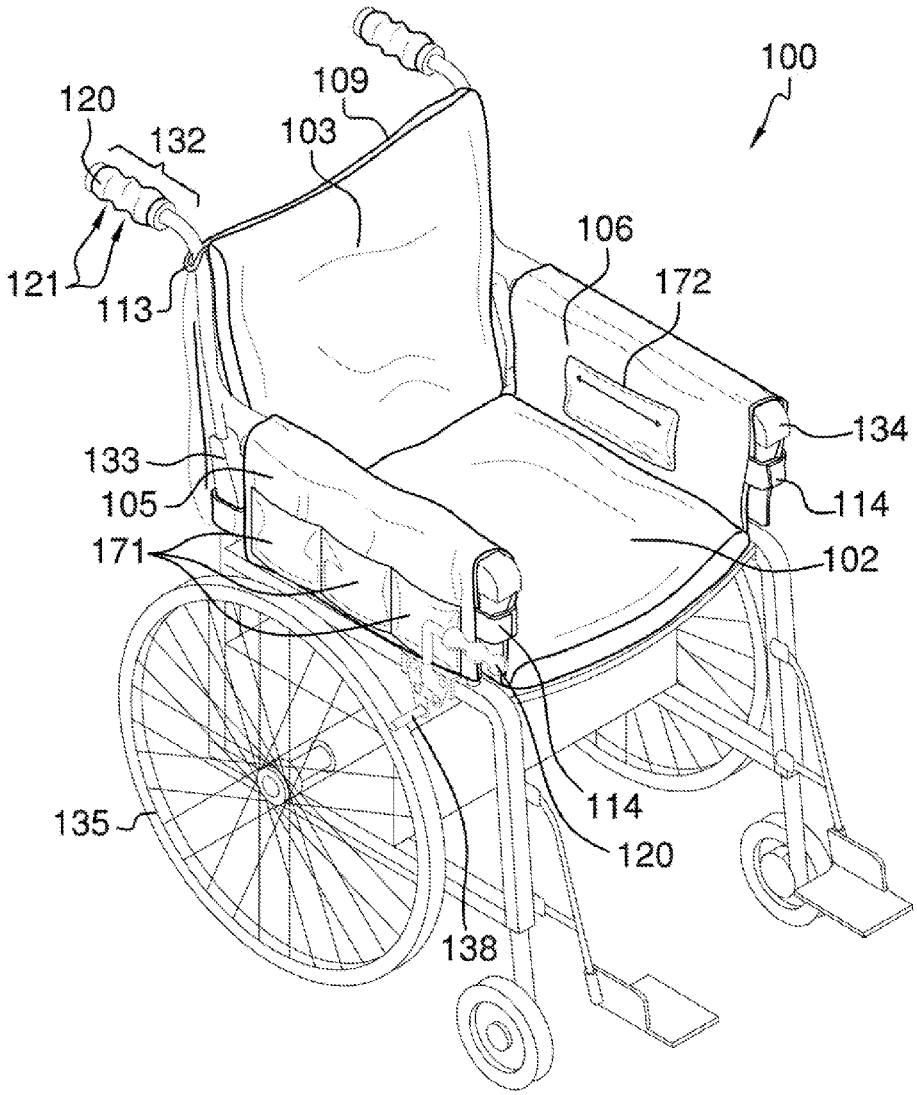
FIG. 1 is an isometric view of the wheelchair accessory kit installed onto an existing wheelchair.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A wheelchair accessory kit 100 (hereinafter invention) includes a wheelchair seat cover 101 formed of a plurality of inter-connected components further defined as a seat member 102, a seat back member 103, a rearwardly facing member 104, a left side member 105, and a right side member 106. The wheelchair seat cover 101 is further defined by a top surface 107 and a bottom surface 108, and applicable to all of the inter-connected components of the wheelchair seat cover 101. The wheelchair seat cover 101 is constructed of a flexible fabric that may be machine washable, and which provides the necessary flexibility to contour atop of an existing wheelchair 130.

The seat member 102 is positioned between the left side member 105 and the right side member 106. The seat back member 103 is positioned between the seat member 102 and the rearwardly facing member 104. It shall be noted that the bottom surface 108 is positioned against the surface of the existing wheelchair 130. The seat back member 103 and the rearwardly facing member 104 form a line 109, which forms a fold when the wheelchair seat cover 101 is installed onto the existing wheelchair 130. Moreover, the seat back member 103 and the rearwardly facing member 104 become generally parallel with one another when installed onto the existing wheelchair 130 such that the line 109 spans across a seatback 131 of the wheelchair 130.

Figure 4:
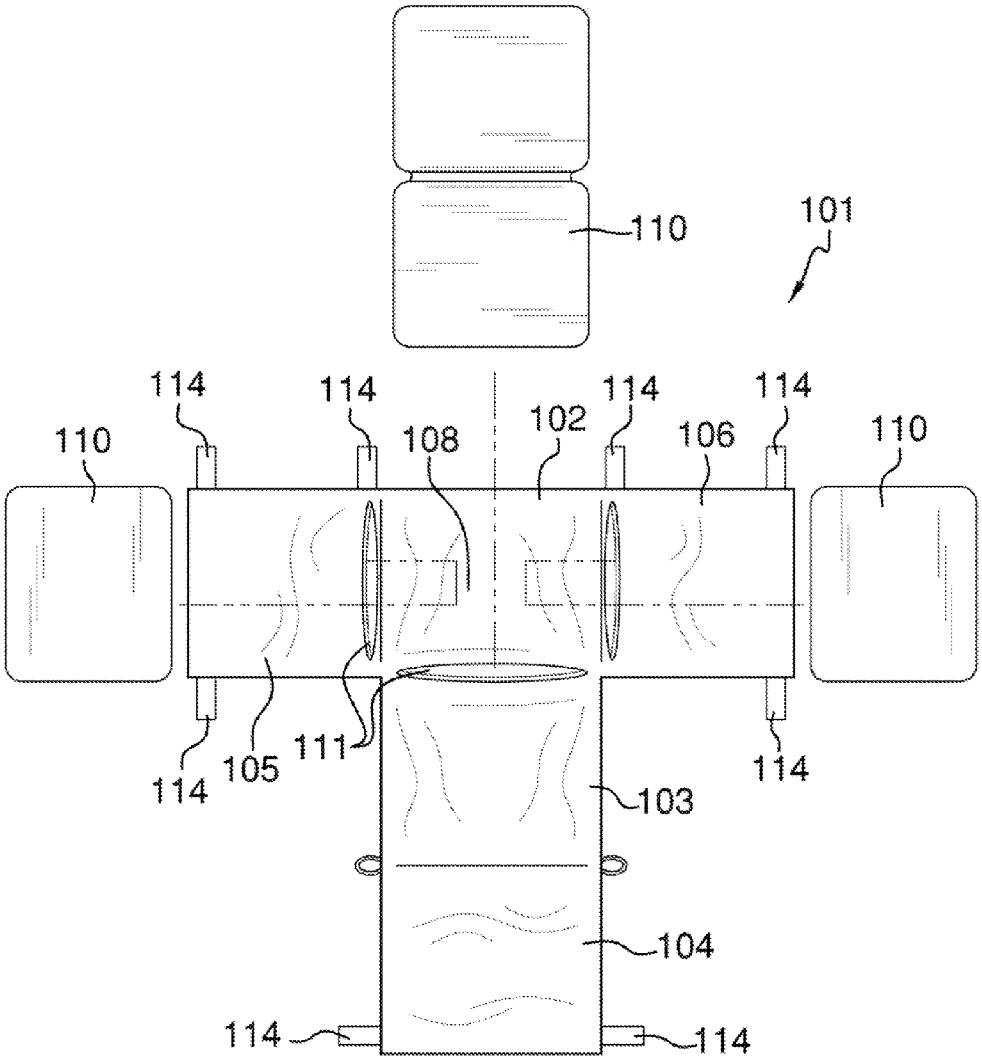
FIG. 4 is a bottom view of the wheelchair seat cover by itself and in a flattened state wherein cushions are removed from pockets provided on the bottom surface of the wheelchair seat cover.

Referring to FIG. 4, the wheelchair seat cover 101 includes padded members 110 that are inserted into padded pockets 111 located on the bottom surface 108 of the seat member 102 as well as the seat back member 103. The padded members 110 provide comfort to an end user when seated in the existing wheelchair 130. The padded members 110 are able to be removed and conversely installed inside of the padded pockets 111 such that the wheelchair seat cover 101 is able to be machine washed as needed. The padded members 110 are ideally constructed of a Visco-elastic or memory foam pad, which provides increased comfort to the end user.

Figure 3:
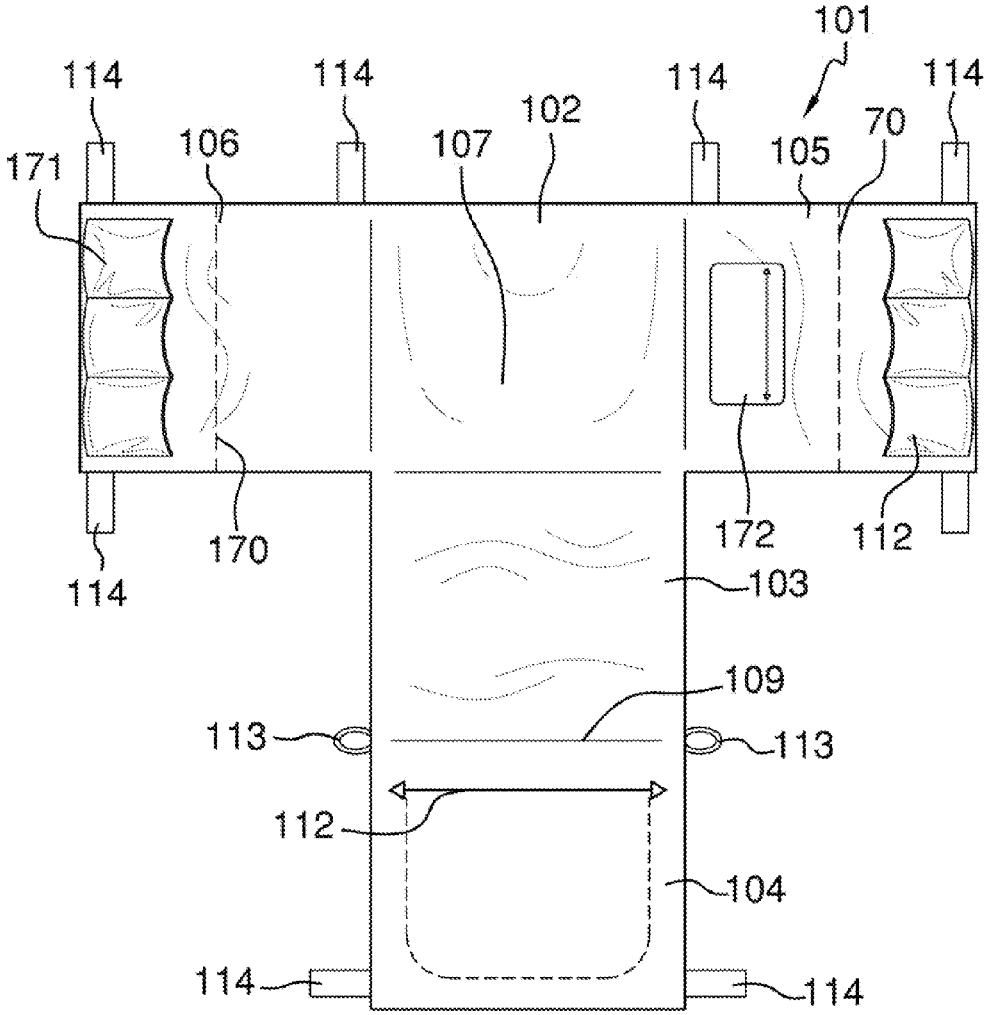
FIG. 3 is a top view of the wheelchair seat cover by itself and in a flattened state in order to depict the various pockets located on the wheelchair seat cover.

Referring to FIG. 3, the wheelchair seat cover 101 further includes a series of storage pockets 112 located on the top surface 107 of the wheelchair seat cover 101. The storage pockets 112 are located on the rearwardly facing member 104. The storage pockets 112 are accessible when the invention 100 is in use, and further provides a means of storing valuables and other objects associated with the end user occupant of the existing wheelchair 130. The storage pockets 112 may have zippered openings or other openings that are sealable via various enclosure means, which enable the storage pockets 112 to be sealed shut when in use thereby preventing valuables or other objects from falling out when in use with the existing wheelchair 130.

The wheelchair seat cover 101 includes a pair of looped members 113 that extend at distal ends of the line 109 formed between the rearwardly facing member 104 and the seat back member 103. The looped members 113 are designed to engage around handles 132 of the existing wheelchair 130 thereby securing the respective components of the wheelchair seat cover 101 onto the existing wheelchair 130.

The wheelchair seat cover 101 further includes a plurality of straps 114 extending outwardly from the wheelchair seat cover 101, and at various locations of the several components. The straps 114 are used to encircle the adjacent bar member 133 of the existing wheelchair 130. Moreover, the straps 114 are arranged in pairs, each of which includes a corresponding strip of nylon hook or loop material, which enables the straps 114 to secure themselves around the adjacent bar member 133 of the existing wheelchair 130. Referring to FIG. 1, the straps 114 are used to encircle the adjacent bar member 133 of the existing wheelchair 130, and may involve armrests 134 of the wheelchair 130.

The invention 100 also includes grip-forming member 120, which is a polymer clay that is pressed onto various surfaces of the existing wheelchair 130. The grip-forming member 120 arrives uncured, and when applied onto the surface of the existing wheelchair 130 shall harden and form a contoured gripping surface that is used by the end user occupant or other person in order to propel the existing wheelchair 130. The grip-forming member 120 is constructed of a polymer clay material, which cures at relatively low temperatures in order to harden. The grip-forming member 120 may be colored, and is manually applied to form the contoured gripping surface 121 (see FIG. 5), which is needed to enhance the overall gripping of the existing wheelchair 130.

Figure 5:
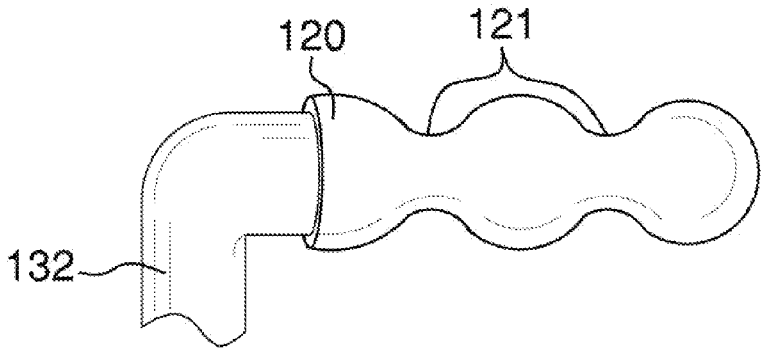
FIG. 5 is a view of the grip-forming member installed on one of the two handles.
Figure 6:
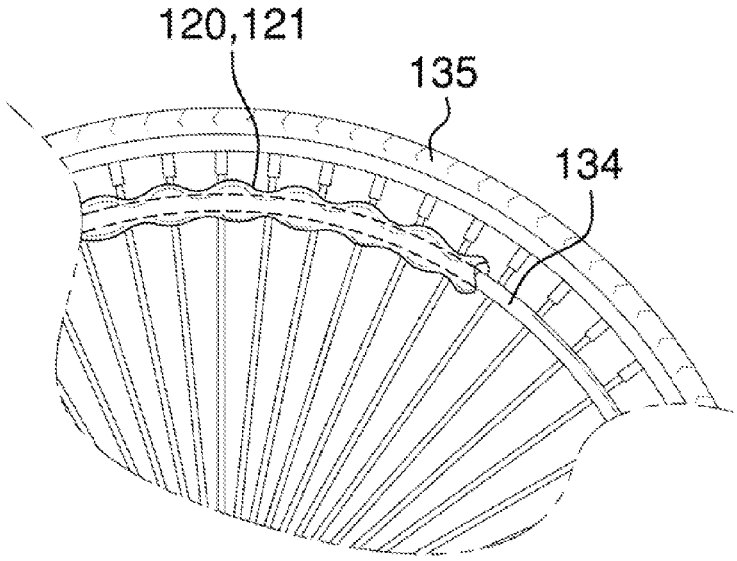
FIG. 6 is a view of the grip-forming member installed on one of the two circular rings adjacent a corresponding wheel of said wheelchair.

Referring to FIGS. 5 and 6, the grip-forming member 120 is applied onto the handles 132 of the existing wheelchair 130 and/or circular rings 135 that are adjacent to wheels 136 of the existing wheelchair 130 and/or wheel locks 138 that are located on opposing sides of the wheelchair 130 and in adjacency of the wheels 136. Upon allowing the grip-forming member to cure at pre-defined conditions, the grip-forming member 120 form the contoured gripping surface 121.

As previously mentioned, the grip-forming member 120 is a polymer clay, which is a sculptable material based on a polymer polyvinyl chloride (PVC), but contains no actual clay in the composition. The polymer clay is commonly known under different brand names associated with hobbyist endeavors.

Figure 2:
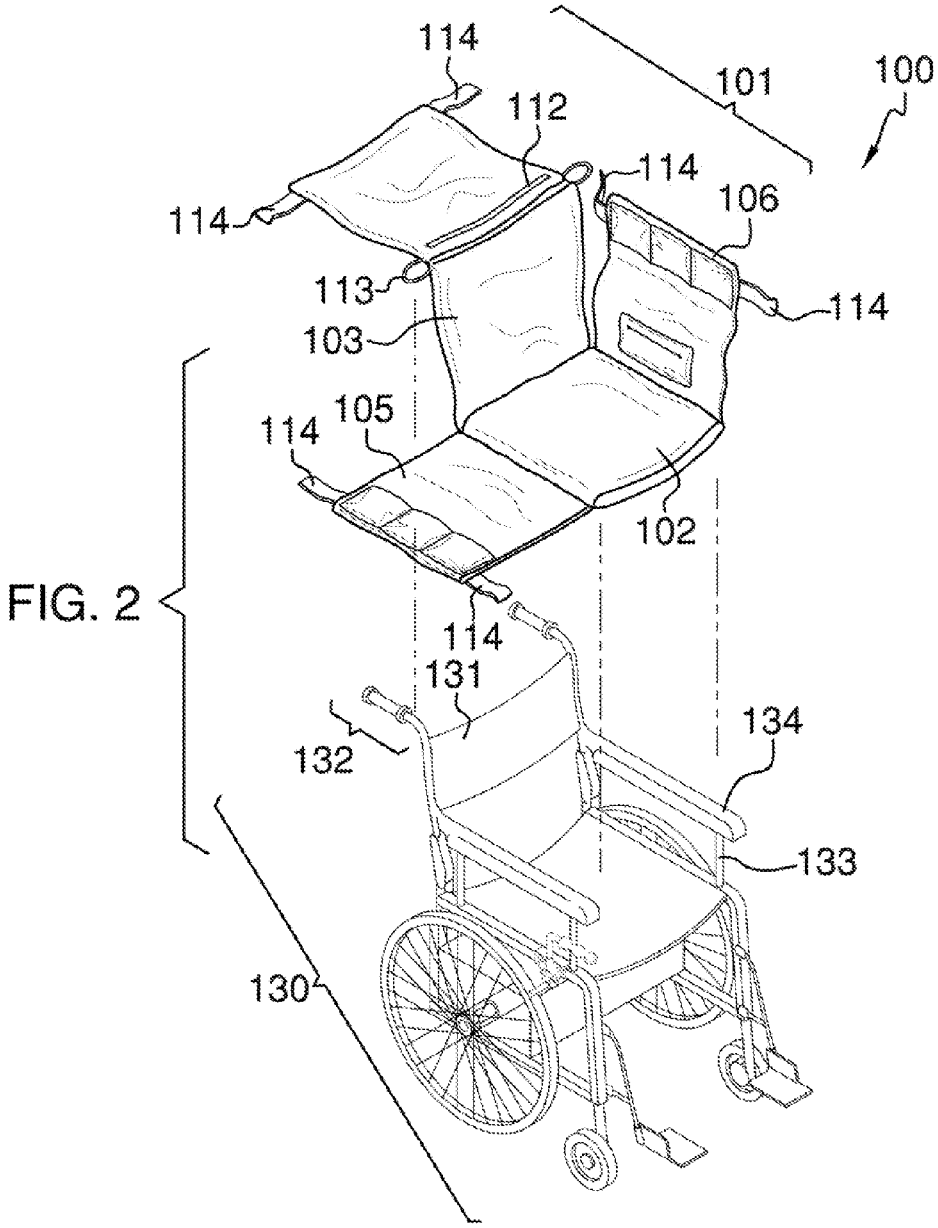
FIG. 2 is another isometric view wherein the wheelchair seat cover is aligned above the wheelchair.

Referring to FIGS. 1-2, the left side member 105, and the right side member 106 are uniquely adapted to fold over top of the respective armrests 134 of the wheelchair 130. Moreover, the left side member 105 and the right side member 106 each include a fold line 170, which aligns with and folds the respective member over the armrest 134. The left side member 105, and the right side member 106 each include a plurality of different pockets that are located on different surfaces, and offer different storage needs. An outer pocket 171 is included on both the left side member 105, and the right side member 106. The outer pocket 171 is comprised of a plurality of individual pockets that are open from above such that an end user may place items therein, and be readily accessible there from. An inner zippered pocket 172 is located on the left side member 105, and the right side member 106. The inner zippered pocket 172 is positioned adjacent the thighs of a seated user of the wheelchair 130. The inner zippered pockets 172 enable the end user to securely store items therein, and which are not readily accessible.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A wheelchair accessory kit comprising:

a wheelchair seat cover fitted onto an existing wheelchair;

a grip-forming member that is applied onto either handles or circular rings adjacent wheels of said wheelchair and/or wheel locks that are located on opposing sides of the wheelchair and in adjacency of the wheels, and which form contoured gripping surfaces with which to grab and propel said wheelchair;

wherein the wheelchair seat cover is formed of a plurality of inter-connected components further defined as a seat member, a seat back member, a rearwardly facing member, a left side member, and a right side member;

wherein the wheelchair seat cover is further defined by a top surface and a bottom surface; wherein the bottom surface is positioned against the existing wheelchair;

wherein the seat member is positioned between the left side member and the right side member; wherein the left side member, and the right side member are uniquely adapted to fold over top of the respective armrests of the wheelchair; wherein the left side member and the right side member each include a fold line, which aligns with and folds the respective member over the armrest; wherein the left side member, and the right side member each include an outer pocket being comprised of a plurality of individual pockets that are open from above such that an end user may place items therein, and be readily accessible there from; wherein the left side member and the right side member each include an inner zippered pocket located on the left side member, and the right side member; wherein the inner zippered pocket is positioned adjacent the thighs of a seated user of the wheelchair.

2. The wheelchair accessory kit of claim 1 wherein the seat back member is positioned between the seat member and the rearwardly facing member.

3. The wheelchair accessory kit of claim 2 wherein the seat back member and the rearwardly facing member form a line, which forms a fold when the wheelchair seat cover is installed onto the existing wheelchair; wherein the seat back member and the rearwardly facing member become generally parallel with one another when installed onto the existing wheelchair such that the line spans across a seatback of the wheelchair.

4. The wheelchair accessory kit of claim 3 wherein the wheelchair seat cover includes padded members that are inserted into padded pockets located on the bottom surface of the seat member as well as the seat back member; wherein the padded members are able to be removed and conversely installed inside of the padded pockets such that the wheelchair seat cover is able to be machine washed as needed.

5. The wheelchair accessory kit of claim 3 wherein the wheelchair seat cover further includes a series of storage pockets located on the top surface of the wheelchair seat cover; wherein the storage pockets are located on the left side member, the right side member, and the rearwardly facing member.

6. The wheelchair accessory kit of claim 3 wherein the wheelchair seat cover includes a pair of looped members that extend at distal ends of the line formed between the rearwardly facing member and the seat back member; wherein the looped members engage around handles of the existing wheelchair thereby securing the respective components of the wheelchair seat cover onto the existing wheelchair.

7. The wheelchair accessory kit of claim 3 wherein the wheelchair seat cover further includes a plurality of straps extending outwardly from the wheelchair seat cover; wherein the straps encircle the adjacent bar member of the existing wheelchair; wherein the straps are arranged in pairs, each of which includes a corresponding strip of nylon hook or loop material, which enables the straps to secure themselves around the adjacent bar member of the existing wheelchair.

8. The wheelchair accessory kit of claim 1 wherein the grip-forming member is constructed of a polymer clay, which cures to harden thereby forming the contoured gripping surface.

9. The wheelchair accessory kit of claim 8 wherein the grip-forming member shall be applied onto handles wheel locks or circular rings adjacent of wheels of the existing wheelchair.

10. A wheelchair accessory kit comprising:

a wheelchair seat cover fitted onto an existing wheelchair;

a grip-forming member that is applied onto either handles or circular rings adjacent wheels of said wheelchair and/or wheel locks that are located on opposing sides of the wheelchair and in adjacency of the wheels, and which form contoured gripping surfaces with which to grab and propel said wheelchair;

wherein the wheelchair seat cover is formed of a plurality of inter-connected components further defined as a seat member, a seat back member, a rearwardly facing member, a left side member, and a right side member;

wherein the wheelchair seat cover is further defined by a top surface and a bottom surface; wherein the bottom surface is positioned against the existing wheelchair;

wherein the seat member is positioned between the left side member and the right side member; wherein the left side member, and the right side member are uniquely adapted to fold over top of the respective armrests of the wheelchair; wherein the left side member and the right side member each include a fold line, which aligns with and folds the respective member over the armrest; wherein the left side member, and the right side member each include an outer pocket being comprised of a plurality of individual pockets that are open from above such that an end user may place items therein, and be readily accessible there from; wherein the left side member and the right side member each include an inner zippered pocket located on the left side member, and the right side member; wherein the inner zippered pocket is positioned adjacent the thighs of a seated user of the wheelchair;

wherein the grip-forming member are constructed of a polymer clay, which cures to harden thereby forming the contoured gripping surface.

11. The wheelchair accessory kit of claim 10 wherein the seat back member is positioned between the seat member and the rearwardly facing member.

12. The wheelchair accessory kit of claim 11 wherein the seat back member and the rearwardly facing member form a line, which forms a fold when the wheelchair seat cover is installed onto the existing wheelchair; wherein the seat back member and the rearwardly facing member become generally parallel with one another when installed onto the existing wheelchair such that the line spans across a seatback of the wheelchair.

13. The wheelchair accessory kit of claim 12 wherein the wheelchair seat cover includes padded members that are inserted into padded pockets located on the bottom surface of the seat member as well as the seat back member; wherein the padded members are able to be removed and conversely installed inside of the padded pockets such that the wheelchair seat cover is able to be machine washed as needed.

14. The wheelchair accessory kit of claim 13 wherein the wheelchair seat cover further includes a series of storage pockets located on the top surface of the wheelchair seat cover; wherein the storage pockets are located on the left side member, the right side member, and the rearwardly facing member.

15. The wheelchair accessory kit of claim 14 wherein the wheelchair seat cover includes a pair of looped members that extend at distal ends of the line formed between the rearwardly facing member and the seat back member; wherein the looped members engage around handles of the existing wheelchair thereby securing the respective components of the wheelchair seat cover onto the existing wheelchair.

16. The wheelchair accessory kit of claim 15 wherein the wheelchair seat cover further includes a plurality of straps extending outwardly from the wheelchair seat cover; wherein the straps encircle the adjacent bar member of the existing wheelchair; wherein the straps are arranged in pairs, each of which includes a corresponding strip of nylon hook or loop material, which enables the straps to secure themselves around the adjacent bar member of the existing wheelchair.

17. The wheelchair accessory kit of claim 16 wherein the grip-forming member shall be applied onto handles or circular rings adjacent of wheels of the existing wheelchair.

* * * * *